US011241852B2

(12) United States Patent
Mayer

(10) Patent No.: US 11,241,852 B2
(45) Date of Patent: Feb. 8, 2022

(54) LINEAR ACTUATED PRESS

(71) Applicant: Maverick Technology Solutions, Phoenix, AZ (US)

(72) Inventor: Ryan Mayer, Phoenix, AZ (US)

(73) Assignee: Rosinbomb, Silver Springs, NV (US)

( * ) Notice: Subject to any disclaimer, the term of this patent is extended or adjusted under 35 U.S.C. 154(b) by 0 days.

(21) Appl. No.: 16/190,124

(22) Filed: Nov. 13, 2018

(65) Prior Publication Data

US 2020/0147915 A1 May 14, 2020

(51) Int. Cl.
*B30B 9/04* (2006.01)
*B30B 15/06* (2006.01)
*B30B 15/34* (2006.01)

(52) U.S. Cl.
CPC ..... *B30B 9/047* (2013.01); *B30B 15/064* (2013.01); *B30B 15/34* (2013.01)

(58) Field of Classification Search
CPC .. B30B 9/04; B30B 9/047; B30B 1/18; B30B 1/181; B30B 15/32; B30B 15/064; B30B 15/34
USPC ..... 100/315, 326, 287, 289
See application file for complete search history.

(56) References Cited

U.S. PATENT DOCUMENTS 4,570,536 A * 2/1986 Dodd ..... B30B 1/18 100/102

FOREIGN PATENT DOCUMENTS

GB 1288419 A * 9/1972 ..... B30B 1/18
WO WO-2008096619 A1 * 8/2008 ..... B30B 1/18

* cited by examiner

*Primary Examiner* — Jimmy T Nguyen
(74) *Attorney, Agent, or Firm* — S. Elizabeth Miller, Esq.

(57) ABSTRACT

A mechanical press is provided that utilizes linear actuation driven by an electric power source and two opposing horizontal platform mounted press plates, an upper fixed plate and a lower traveling plate arranged vertically and tracked via vertical track posts to press resin, oils, extracts, or compounds from a raw plant material. The press plates are heated during press operation and function to heat and melt the desired plant products and the force from the press plates squeezes the melted materials out of the plant and onto a parchment paper or into a melt groove to flow to a collection tray.

9 Claims, 8 Drawing Sheets

LINEAR ACTUATED PRESS

BACKGROUND OF THE INVENTION

1. Field of the Invention

The present invention is in the field of extracting essential compounds from organic plant materials and pertains particularly to methods and apparatus for pressing organic materials under heated conditions to extract essential compounds.

2. Discussion of the State of the Art

In the field of organic material processing, there are commercial systems available for closed loop solvent processing of organic materials such as cannabis, for example. In the case of cannabis, desired compounds within the organic cannabis material such as trichomes for example can be separated from the raw material using solvent gasses and cooling means. Drawbacks to this approach include events where residual organic compounds or other chemical residues from solvents may contaminate the final product, and events where safety may be compromised by solvent leaks or spills.

More recently in the art, commercial press systems have become available, which do not require solvents, where material may be compressed under heated conditions to squeeze melted compounds in the form of more viscous liquids from organic raw materials. These commercial presses typically use air compressors and/or hydraulic pressure systems to operate linear press components creating noise, safety issues, and maintenance issues including seal replacement, fluid replacement, valve replacement, and like issues. Such systems may not be easily scaled down for non-commercial use because of cost and required adherence to numerous safety issues and regulations.

It has occurred to the inventor that with deregulation and legalization of cannabis in multiple markets, demand for easily portable and completely organic systems and methods for extracting extracts and other essential compounds from raw cannabis is rising. Therefore, what is clearly needed is an all-electric portable plant material press for extracting essential compounds that is completely organic and easy to operate and maintain.

BRIEF SUMMARY OF THE INVENTION

A mechanical press is provided and includes a platform base plate having a length, a width, and a uniform thickness, a device housing secured centrally over the platform base plate, the device housing having at least front, rear, two side panels, and a top panel having uniform thickness, an electric linear actuator assembly disposed centrally and in a vertical orientation within the device housing and fixedly mounted to the platform base plate in strategic position within the device housing, the linear actuator including a travel screw having a lower fixed gear, an actuator connection block hosting a planetary gear set, and an electric motor having a drive gear fixed to the motor shaft, a lift collar having a lower annular tube section with internal threading matching the external threading on the travel screw and an upper attachment seat fixed to a lower press plate platform having a length a width, and a uniform thickness, two or more vertical track posts having a uniform length and diameter arranged and spaced apart symmetrically, the track posts fixedly mounted to the device housing and extending vertically through the lower press plate platform through provided openings placed through the platform, the track posts functioning as a lift track for the lower press plate platform, a lower press plate having a length, a width, and a maximum thickness centrally mounted to the top surface of the lower press plate platform, an upper press plate platform having a length, a width, and a maximum thickness, the upper press plate platform aligned with and held in a same planar relationship to the lower press plate platform, the upper press plate platform having openings placed orthogonally therethrough to accept the track posts and wherein the upper press plate platform is fixed to the track posts at the upper ends of the posts, an upper press plate having a length, a width, and a uniform maximum thickness centrally mounted to the bottom surface of the upper press plate platform sharing vertical alignment and a parallel planar relationship with the lower press plate, a first electric heating element embedded into the lower press plate, a second electric heating element embedded into the upper press plate, the first and second electric heating elements including at least one feedback sensor to report temperature, a heating control interface and display including at least one electronic circuit for driving the heating control interface and display, a press activation interface including an electric button for raising the lower press plate platform to press and an electric button for releasing the lower press plate platform from press, and a power supply mounted within the device housing and connected by wire to the electric motor, the first and second heating elements, and to the at least one electronic circuit driving the heating control interface and display.

In one embodiment, the press force combined with active heating of the lower and upper press plates acts on raw material placed between the press plates to extract resins, oils, extracts, or compounds from the ram material, the heat rendering the resins, oils, extracts, or compounds in a highly viscous liquid state. In one embodiment, the lower press plate has a convex press surface, the upper press plate having a matching concave press surface. In another embodiment, the lower press plate has a conical press surface, the upper press plate having a matching funnel surface.

In one embodiment, the press force created by the linear actuator is equal to or greater than 1,500 pounds per square inch. In one embodiment, the mechanical press further includes a groove milled along a groove pattern around the press plate surface of the lower press plate, the groove including an exit chute breaking out of the press plate, the groove bottom graduating downward from the rear of the plate to the front of the plate and out of the exit chute.

In one embodiment, the material pressed is protected in a fold of parchment paper and the pressed resins, oils, extracts, or compounds are collected off the parchment paper. In one embodiment, the maximum press force is adjustable. In one embodiment, the distance that the lower press plate platform recedes after press release may be set by a user. In another embodiment, parchment paper may be replaced by another material, such as foil or any other heat-resistant material with a non-stick surface known in the art.

DETAILED DESCRIPTION OF THE INVENTION

The inventors provide a unique organic press and methods of use thereof that enable completely organic processing of a raw plant material to a viscous (high viscosity) extract product. The present invention is described in enabling detail using the following examples, which may describe more than one relevant embodiment falling within the scope of the present invention.

One goal of the invention is to enable resins, oils, extracts, or compounds of raw plant materials to be chemically and physically separated from the plant material by means of pressing the material between two press plates, the press plates having a means to heat to a desired temperature for heating the pressed material. Another goal of the invention is to provide a linear press means that may produce a press force capacity of approximately 1,500 pounds per square inch between the press plates, wherein the linear press means avoids compressor components or hydraulic components that may be cumbersome, noisy and may be the source of contamination and may be difficult to scale down for consumer market use.

Another goal of the present invention is to have a press drive means such as a linear actuation device that runs on electricity to achieve relatively silent, efficient and repeated pressing of multiple sequential press loads consisting of raw material, wherein the resins, extracts, oils, or compounds may be pressed onto a parchment paper, or into a groove for transfer of the highly viscous resin, oil, extract, or compound to a means for collection like a receptacle like a tray.

It may be an object of the invention to secure a means for lifting the lower press plate utilizing the linear actuator by having a vertical travel screw that may be turned in place support a lift collar threaded over the travel screw, the lift collar fixed to a vertically tracked platform that hosts the lower of the two press plates, wherein the track system comprises at least two vertical track posts.

One object of the invention may be to provide a means, in addition to heat and press force, to further assist separation of the viscous resins, oils, extracts, or compounds from the raw plant materials by shaping the press surfaces of the two press plates and or by sloping the groove bottom at an angle from horizontal toward the destination point for product collection.

Figure 1:
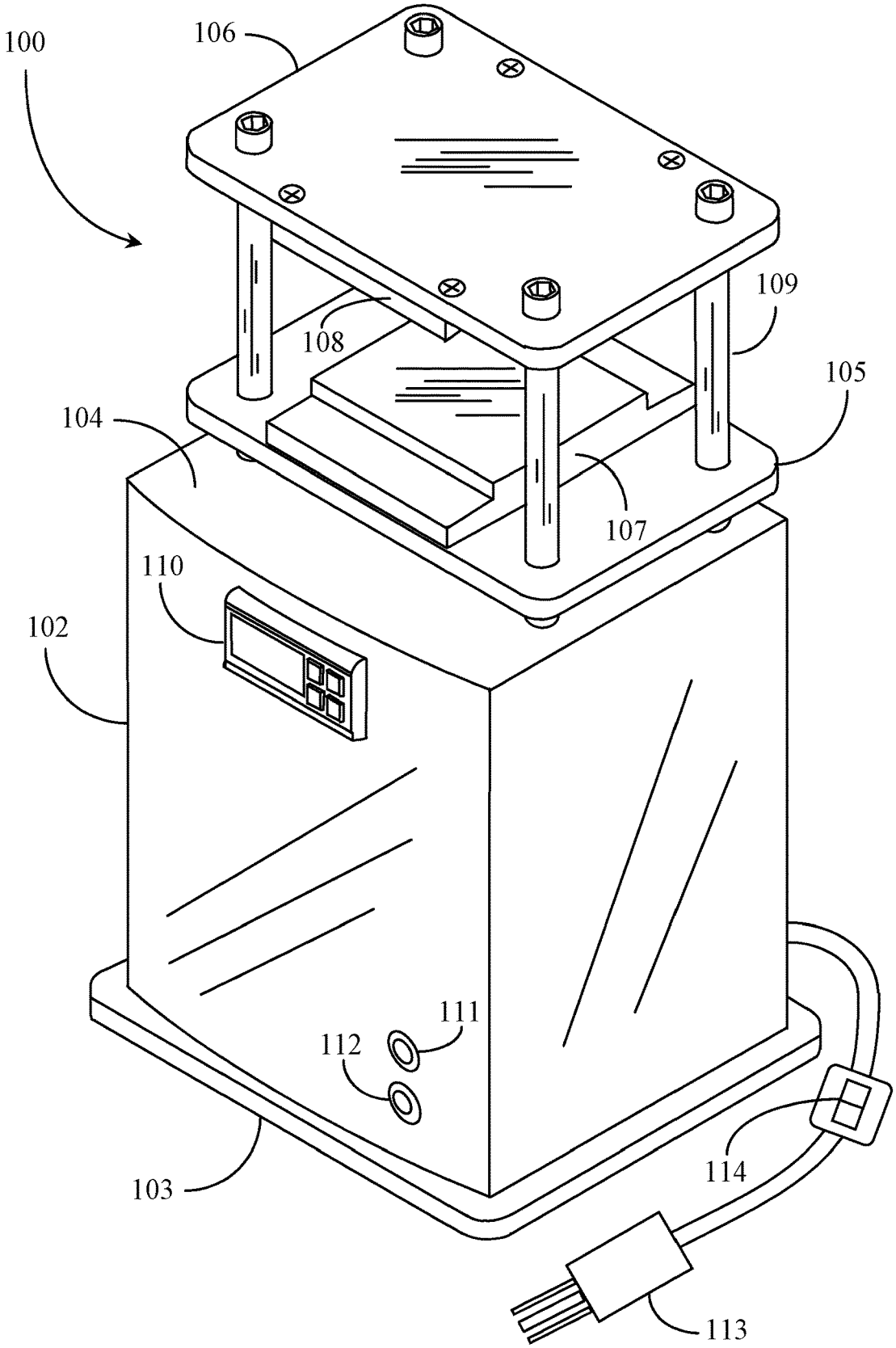
FIG. 1 is a perspective view of a linear actuated press for processing organic plant material according to an embodiment of the present invention.

FIG. 1 is a perspective view of a linear actuated press 100 for processing organic plant material according to an embodiment of the present invention. Linear press 100 is a consumer-based table top press adapted to press organic plant material under heat to separate essential extracts, oils, resins, or compounds from the plant material. Press 100 weighs approximately 13 pounds and may process up to 7 grams of organic materials each press run resulting in up to one third of the gross weight in extracted oils extracts, resins or compounds.

Press 100 includes a device housing 102 having a front side, a rear side, a left and right side, and a top panel 104. It may be assumed that housing 102 includes a floor panel though it is not required to practice the present invention. Housing 102 is fixed down over a press base plate 103 that may be fabricated of stainless steel or another durable machine material. Base plate 103 may rest on or may be mounted to a table top or bench top for consumer use. In one embodiment, base plate 103 may include legs or feet or may simply sit flat on a table.

Device housing 102 including top panel 104 may be fabricated of stainless-steel sheet metal one sixteenth to one eighth of an inch standard thickness. Device housing 102 encloses a linear actuator (not illustrated) that drives (lifts) a lower press plate platform 105 having a lower press plate 107 mounted thereon against a fixed upper press plate platform 106 having an upper press plate 108 mounted thereon. Press 100 includes a symmetrical pattern of linear press track posts 109 fixed to a press frame component or seat component (not illustrated) beneath top panel 104. Each track post 109 is held parallel and orthogonal to the press plate platforms, one post at each corner and are of equal length. Track posts 109 may be solid stainless-steel rods or thick wall stainless steel tubes and are annular in cross-section.

Lower press plate platform 105 may be fabricated of a stainless-steel plate material (or other suitable material) of perhaps three eights of an inch to a quarter of an inch thickness. Lower press plate platform 105 includes four openings, one at each corner of the platform in alignment with the same pattern as the track posts. Lower press plate platform 105 includes a lift collar (not illustrated) that makes connection (threaded on to) a linear travel screw at center underneath the platform.

The inside diameter of the track post openings in lower press plate platform 105 is held just larger (within acceptable machine tolerance) than the outside diameter of linear track posts 109 so the lower press plate platform may fit over the track posts and be urged upward toward upper press plate platform 106, which is fixedly mounted at the top of the four track posts 109. Track posts 109 and the inside surface of the track post openings through platform 105 may be coated to reduce friction and to prevent kinking or catching as the lower press plate platform travels over the track post pattern. A Teflon-based material, or any other similar non-stick material know in the art, such as thermoline, may be applied as a non-stick permanent coating to the track posts and to the post openings in lower press plate platform 106.

A linear actuator (not illustrated) drives a vertical screw with the aid of an electric motor that runs on alternating or direct current. The linear actuator may be mounted within device housing 102 centrally and beneath lower press plate platform 105. Press 100 includes a power cord with a three-pronged AC plug that fits into a typical three prong outlet. A cord switch may be provided and installed for switching to power on or to power off. More detail about a linear actuator enabling the press function of press 100 is provided later in this specification. In a one embodiment, press plates 108 (upper press plate) and 107 (lower press plate) are machined flat to sit flush with the respective platforms and are mounted to the respective platforms via machine mounting screws. In this example, both upper and lower press plates are stepped (material removed) at the front and back sides to enable more efficient plate heating and to define the press area for placing raw material to be pressed.

Press plates 107 and 108 are heated in a preset and controlled manner during press operation. Press 100 includes a user heat control interface 110 for presetting heat level for each press plate, or in one embodiment for both press plates in tandem. Control interface 110 includes a display that displays current heat levels for each press plate to the user. The display may be a liquid crystal display (LCD), a light emitting diode (LED) display, or an organic liquid crystal display (OLED) display. The primary function of user heat control interface is setting heat level for each plate, the heat level to be maintained during press operation. Other functions may also be available through control interface 110 without departing from the spirit and scope of the invention.

Lower press plate platform 105 is operated from the front face of the press by a user selecting and pressing one of two available buttons 111 (raise plate) or 112 (lower plate) while the press is plugged in and powered on. A user may place up to 7 grams of organic plant matter onto a collection parchment sheet (not illustrated), fold the sheet over to cover the top of the plant material and place the arrangement onto the lower press plate 107 (top press surface). The user may then close the press by selecting button 111 (raise press plate) until the raw plant material is tightly pressed between the two plates. Press 100 may exert up to 1,500 pounds per square inch (PSI) on the pressed materials under heat set within a range between or about 185 degrees Fahrenheit to 210 degrees Fahrenheit. The practical heat level of one or both plates may be based upon the type of raw materials and the identification of the resins, oils, extracts or compounds sought for extraction.

Press 100 may include material preparation and collection tools (not illustrated). For example, a hand-held material compacting device may be provided so that a user may place a singular raw material plug between the parchment paper instead of dry crumble. After press, a user may remove the pressed plant matter (plug) and set the paper aside to cool before using a collection tool to scrape off the viscous extract from the paper surface. The extract, oil resin or compound melts due to the heat maintained in the press plates and is forcefully pressed out of the raw plant material. The collected extracts, oils, resins or compounds may be set left on the heavy parchment paper to cool before collection for personal use or to add to a batch amount for later use.

It will be apparent to the skilled artisan that press 100 may be utilized to extract oils, resins, extracts, or compounds and other organic compounds from a variety of raw plant materials without departing from the spirit and scope of the present invention. For example, oils may be pressed out from oil bearing plant material such as flax seed. In some examples, different ranges of plate heating may be provided for different types of organic raw plant matter bearing different compounds for extraction. In a preferred embodiment, press 100 is utilized to process flower material of a cannabis plant.

Figure 2:
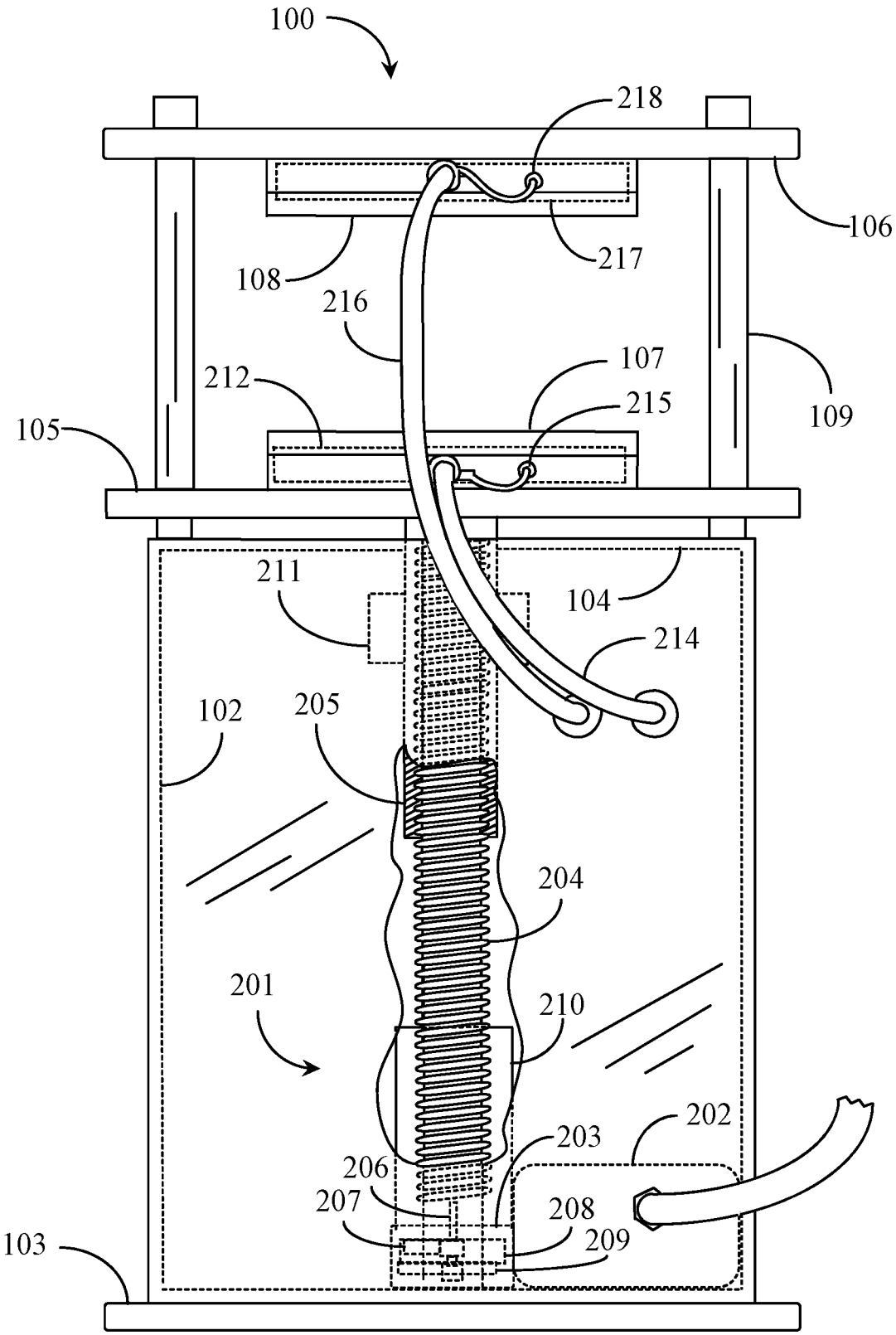
FIG. 2 is a rear elevation view of the press of FIG. 1 with a portion of the rear wall removed for clarity in description of a linear interface enabling press plate travel.

FIG. 2 is a rear elevation view of press 100 of FIG. 1 with a portion of the rear wall removed for clarity in description of a linear interface enabling press plate travel. Press 100 is viewed from the rear in this example. A power supply 202 is provided in compliance with FCC guidelines. Power supply 202 is disposed within device housing 102 and may be mounted to the floor panel of device housing 102 with a power line routed through an opening provided through the rear panel out to plug. Press 100 is driven and supported vertically by a linear actuator 201. Linear actuator 201 includes a vertical travel screw 204. Travel screw 204 may be a heavy-duty stainless-steel screw having external threads that match female threading on a lower press plate lift collar 205, depicted partly in section view at the lower end to depict thread interfacing. Lift collar 205 may be a durable stainless-steel pipe or stainless-steel tubing having internal threads matching the external threading on travel screw 204. Lift collar 205 may be attached orthogonally to lower press plate platform 105 by welding or other hardware means such as by flange mounting bracket mounting or the like. In one embodiment, collar 205 may be retained within a seat installed beneath platform 105 substantially at the center point of the platform. A through opening is provided through the center of top panel 104 at an inside diameter enough to accept the outside diameter of lift collar 205 extending into the device housing.

Travel screw 204 may be threaded into lift collar 205 to the full depth of the collar or to a specified mark or designated distance of thread involvement. Linear actuator 201 includes an actuator connection block 203. Connection block 203 comprises a steel encasement containing a gear set mounted in a planetary fashion with the gears meshed together between an electric drive motor 210 and a vertical travel screw 204, the electric motor having a drive gear 206 (fixed on motor shaft). Gears are depicted as broken rectangles in this example. Drive gear 206 meshes to a first translation gear 207 (pin mounted rotable), which in turn meshes to a second translation gear 209 (pin mounted rotable), and to a screw gear 208 fixed permanently by weld or otherwise fixedly attached to travel screw 204. Motor 210 is vertically mounted to one end of actuator connection block 203 and the base of travel screw 204 is mounted to the other end. Motor 210 may be a copper wound electric motor held substantially parallel or in line with travel screw 204.

In one embodiment, the bottom cover of actuator connection block 203 is ground flat or machined flat for flush mounting to the bottom panel of the device housing and base plate 103. (hardware not illustrated). In one embodiment, block 203 has a steel bottom cover screwed down over the block to protect the gear set inside. Connection block 203 may be mounted to position on the bottom panel of device housing 102 or directly on to the base plate (no bottom panel) using machine screws of a proper length from the bottom surface of base plate 103 mount openings may be provided through the base plate and screw head recesses to compensate for the head height of the screw.

In one embodiment, linear actuator 201 is bracketed and mounted within device housing 102 such that travel screw 204 is optimally perpendicular with the lower press plate platform 105 and may easily be threaded into lift collar 205. Motor 210 is parallel with travel screw 204 in this embodiment, however in another embodiment, motor 210 may be mounted orthogonally to the orientation of travel screw 204 wherein at least one drive gear is orthogonally oriented from a translation gear inside of connection block 203.

When motor 210 is activated to drive lift collar 205, travel screw 204 may rotate under power in either direction forward or reverse to advance lower press plate platform 105 upward to press or downward to release from press. Motor 210 may be wired to power supply 202 through actuator connection block 203 or through the motor housing. Press 100 includes necessary display and heat-set circuitry 211 to drive the user heat control interface 110 of FIG. 1. Circuitry 211 may include a small micro-controller and memory for preserving press settings, and for displaying information for the user in addition to plate temperature readouts. In one embodiment, the display screen associated with user heat control interface 110 is a touch screen and can be manipulated with touch input by a user to force display of other information such as time, date, ambient temperature, etc. Circuitry 211 may be wired to power supply 202 within the device housing (wires not visible).

Lower press plate 107 includes a heating element or plug 212 embedded within the plate. A power wire 214 is provided and connected to heating element 212 through a wall of lower press plate 107. A feedback sensor wire 215 may be connected to an embedded thermocouple or other temperature sensor. In this way current temperature readouts for lower press plate 107 may be displayed for view on the display screen of heat control interface 110. Other temperature sensing devices might also be used in place of a thermocouple without departing from the spirit and scope of the present invention. Similarly, a power wire 216 is provided to heat an embedded heating element 217 within fixed upper plate 108. A sensor wire 218 may connect to an embedded thermocouple. Sensor feedback wires 215 and 218 may be routed inside the device housing to circuitry 211 for read out. A power line may be routed from power supply 202 to circuit 211 for powering on and enabling user input to set temperatures and to read out temperatures at heat control interface 110.

Figure 3:
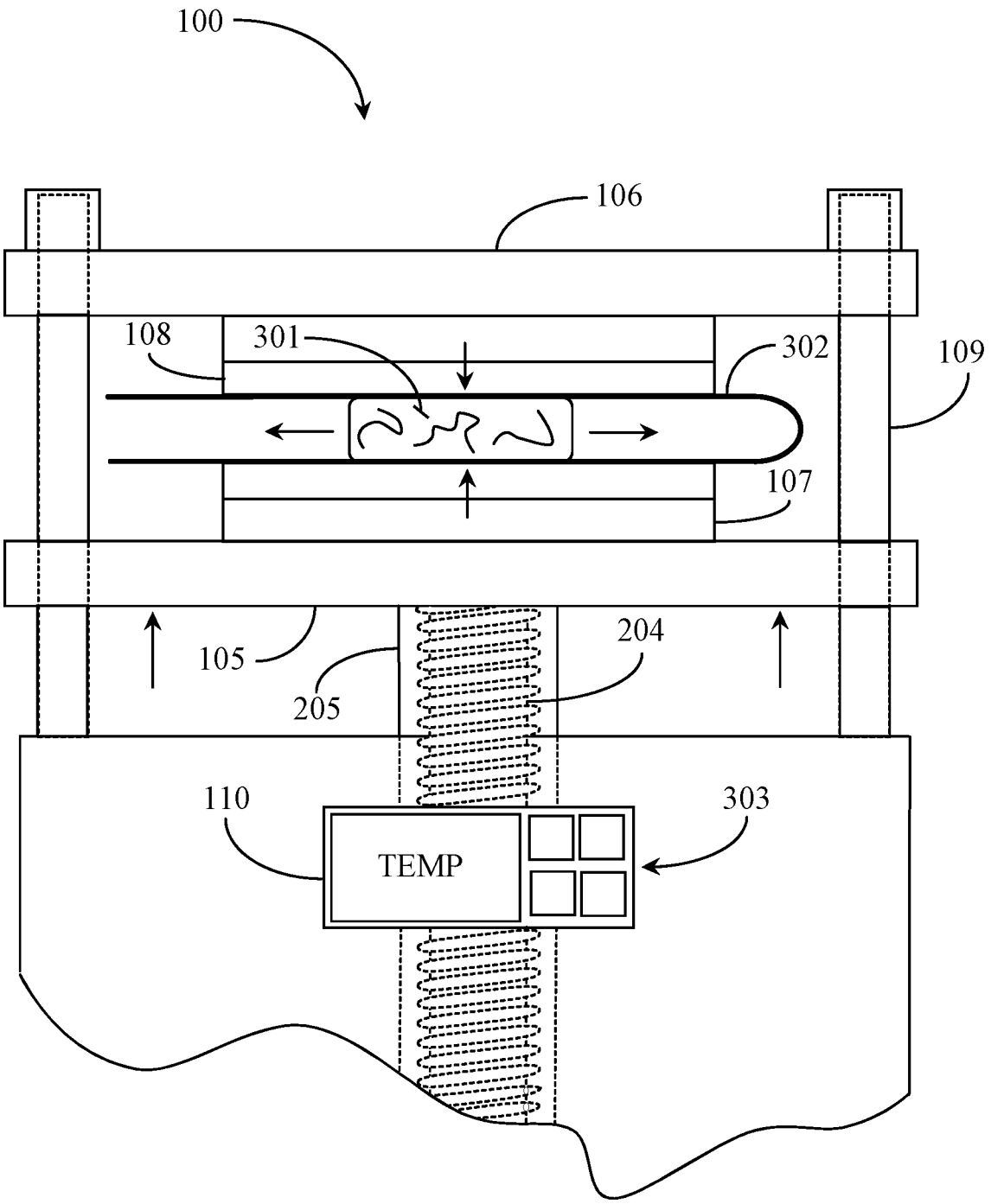
FIG. 3 is an enlarged view of the press parts of the press of FIG. 1 engaged in pressing material according to an embodiment of the present invention.

FIG. 3 is an enlarged view of the press parts of press 100 of FIG. 1 engaged in pressing material according to an embodiment of the present invention. In one embodiment, a user may place a prepared batch of raw plant material embodied herein as a compacted cannabis plug 301 between the fold of a large section of heavy parchment paper 302. A compact plug of cannabis at a level of humidity preventing dry crumbling is preferred raw material for pressing. A hand-held tube press or similar hand-held compacting device (none illustrated) may be provided to aid in compacting the plant material into a form for pressing. In another embodiment, a raw material for pressing may be moist and pliable such that a user may compact and shape it for press by hand.

It may be noted herein that compacting cannabis or other raw materials prior to pressing the materials is not required in order to practice the invention as the raw material may be dry crumble and may still be pressed. However, in a preferred embodiment up to 7 grams of cannabis having a level of humidity that enables compaction of the material is desired. One reason for compacting the material before pressing is that particulate matter crumbled or displaced from the raw material may inadvertently become mixed with the pressed and melted viscous extract that is forced peripherally out of the raw plant material under press of approximately 1,500 PSI. Therefore, the presence of a uniform shaped plug greatly reduces the occurrence of contaminate particles entering the melted extract, which flows beyond the perimeter of the plug in a state of pressed.

Lower press plate 107 (moving plate) and upper press plate 108 (stationary plate) may be individually heated as previously described above using heat control interface 110. An arrangement of buttons 303 (four buttons) may be manipulated to scroll to a desired temperature setting for one or for both plates and lock the temperature in as heating instruction for the heating elements. The display screen may display the selected temperature for set and then may display the current temperature of the plate or plates wherein as the plates continue to warm the readout continues to display gradually higher temperatures until the desired temperature is reached. In one aspect, the top two control buttons 303 may be used to set temperature for the top plate while the lower two set temperature for the bottom plate.

Temperature may be changed by the user during press for one or both press plates by manually overriding the settings to raise or lower current plate temperatures. In a preferred embodiment for pressing cannabis, a temperature range from 185 degrees Fahrenheit to approximately 210 degrees Fahrenheit may define a broad "melt window". A user may experiment and make determinations based on empirical data and strain including "content" of cannabinoids like Tetrahydrocannabinol (THC) and Cannabidiol (CBD).

Figure 4:
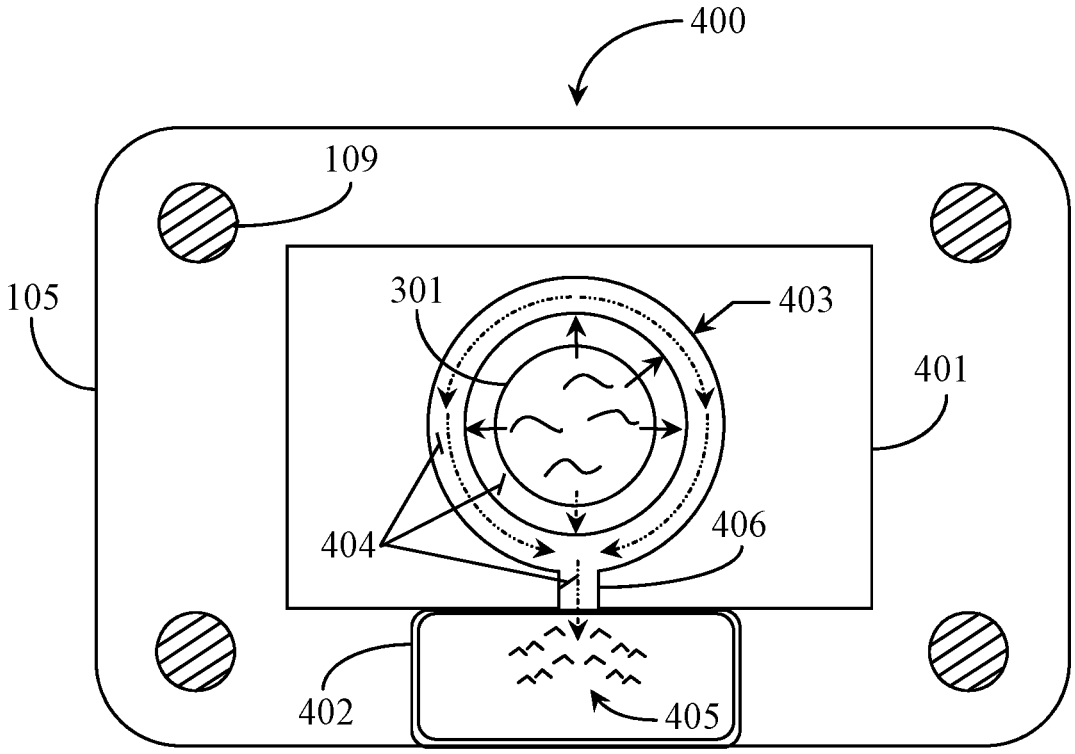
FIG. 4 is an overhead view of a lower press plate and platform assembly according to another embodiment of the present invention with the upper stationary plate and platform removed for clarity.

FIG. 4 is an overhead view of a lower press plate and platform assembly 400 according to another embodiment of the present invention with the upper stationary plate and platform removed for clarity. Assembly 400 may include lower press plate platform 105 slidably mounted over track posts 109 depicted as sectioned off in this view. In this example, a lower groove plate 401 is provided in place of the lower press plate 107 of FIG. 3. Groove plate 401 may or may not be stepped to reduce mass for heating. Groove plate 401 may be three eights of an inch to one half of an inch in thickness. Groove plate 401 may be machined or otherwise fabricated with a groove 403 functioning as a resin deposit boundary disposed around the press surface area of the groove plate.

Groove plate 401 performs essentially the same function of press plate 107 during a press and heat process. However, in this embodiment a parchment paper is not required between material plug 301 and press surfaces. Groove 403 may be a rectangular groove having two vertical walls and a flat groove bottom. In one embodiment, groove 403 may be fabricated with a rounded groove bottom. In this embodiment groove 403 is a circular groove pattern however, other geometric groove patterns may also be utilized without departing from the spirit and scope of the present invention. In one aspect, the groove pattern may be an ellipse, a triangle, a rectangle, a trapezoid, or another shape.

In a preferred embodiment, groove 403 is fabricated or machined to be gradually deeper over distance from a relatively shallow point off the rear of the press surface to a deepest point at the opposite side of the groove pattern. Groove 403 includes a melt groove exit chute 406 that intersects orthogonally with groove 403 toward the front of the press plate and channels viscous melt compounds oils, extracts, or resin toward the front and center of the linear press. In one embodiment, groove 403 has a slope angle having a minimum depth (from press surface to groove bottom) at the rear of press plate 401 and a maximum depth at the front of press plate 401 where chute 406 begins. Exit chute 406 may have a much sharper slope angle of groove bottom to speed up the flow of viscous oils, resins, compounds, etc. out of groove 403 and into a collection tray 402. In one embodiment, a nonstick surface 404 may be applied to the press surface beneath plug 301, the interior of groove 403 and groove melt exit chute 406. There is a wide array of heat resistant and non-gassing Teflon surface coatings available in the art and known to the inventor that may be applied.

Collection tray 402 may be a stainless-steel tray with a non-stick coating, such as a Teflon or thermolon, applied on the bottom and inside walls of the tray. Viscous material 405, depicted inside tray 402, travels from plug 301 under press force with the press plates heated into groove 403, down groove 403 to the front behind exit chute 406 and into tray 402. A user may press many plugs sequentially without breaking to collect resin, extract oils or compounds from individual collection papers. Product 405 may be left in tray 402 to cool and to be further processed or stored for use. Tray 402 may have a top cover in one embodiment though a cover is not illustrated in this example. In one embodiment, tray 402 may be placed on press plate platform 105 in front of exit chute 406. Plate material may be removed from the forward side of press plate 401 in the area of tray 402 by milling so that a user may tuck tray 402 just under exit chute 406 so that the exiting material may drip or flow out and directly into tray 402 without coming into contact with a tray wall.

Figure 5:
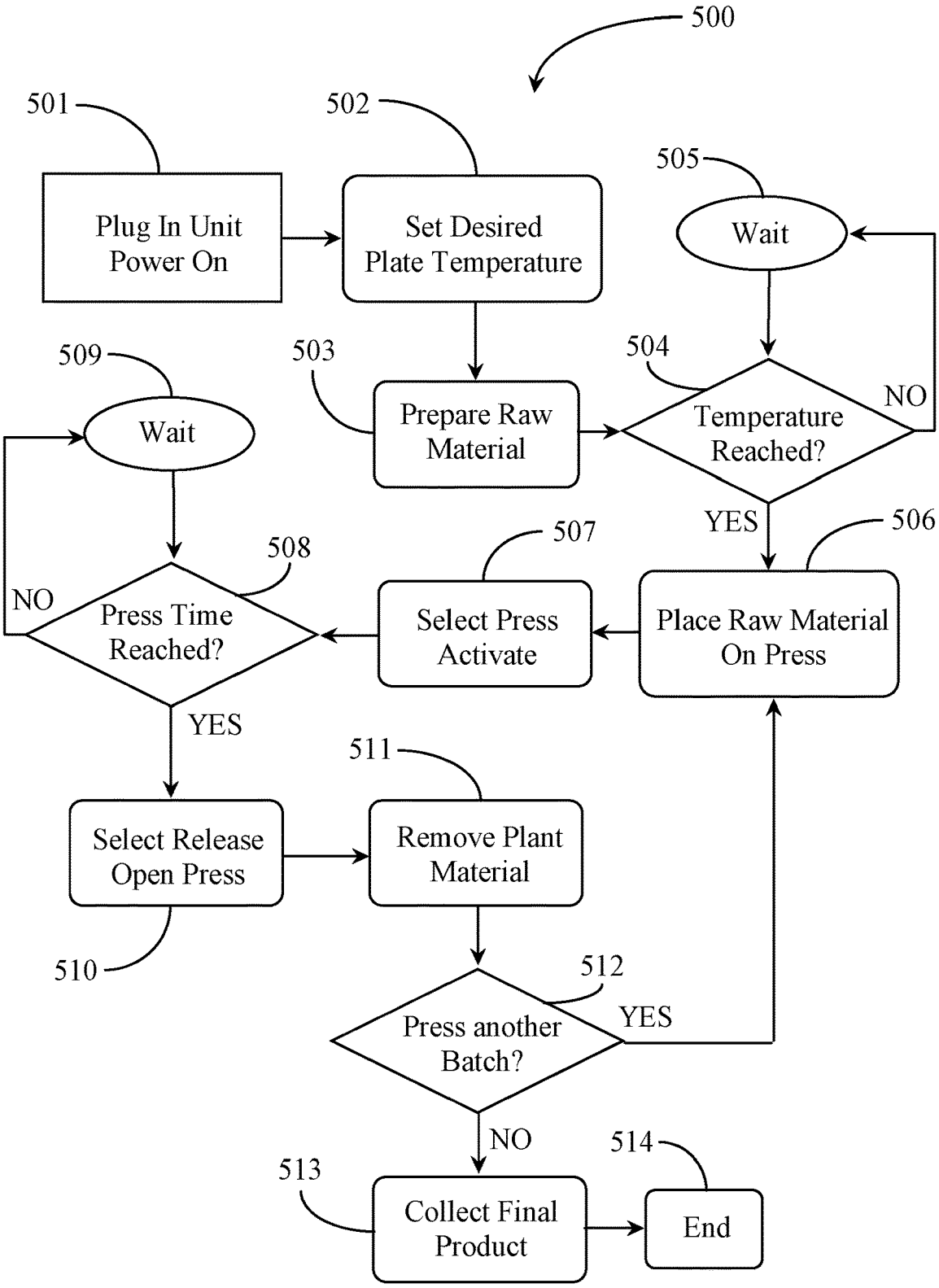
FIG. 5 is a process flow chart depicting steps for preparing and pressing organic material to extract viscous materials using the linear actuated press according to one or more aspects of the invention.

FIG. 5 is a process flow chart 500 depicting steps for preparing and pressing organic material to extract viscous materials using the linear actuated press according to one or more aspects of the invention. In step 501, a user may plug in the linear press unit analogous to the units described previously. The press unit typically has a three-pronged AC plug and may have a switch for power on power off on the cord itself or on the unit. Also, in step 501, the unit may begin heating the press plates automatically according to the last user heat settings. At step 502, a user may set desired plate temperatures for heating the raw plug material while pressing the material. Step 502 may be skipped if the user does not which to apply different temperature settings than those already programmed into the unit. A user may set the maximum temperatures for each press plate individually in one embodiment. In another embodiment, one setting affects both press plates and they maintain the same temperature set by the user.

At step 503, a user may begin preparing raw material such as cannabis for pressing. It may take a small amount of time for the press plates to attain the desired press temperature. Step 503 may be practiced in the interim. In one aspect, a user may form a cannabis plug up to 7 grams of weight by hand or with a hand-held compactor and insert the formed plug between a fold of parchment paper, so it is covered on top and bottom sides. At step 504, the user may determine if the press temperature set by the user in step 502 has been reached. At step 504, if the press temperature has not yet been attained then the process may loop back to step 505 to wait and back to step 504 to make the determination again. In one aspect, the screen associated with the user heat control interface displays the temperature graduation as it occurs through reporting of sensor feedback data to the display from thermal sensors in the plates.

If at step 504, the user determines that the press plates have attained temperature and the linear actuated press is ready for use, the user may place a parchment paper containing a plug of raw material onto the lower press plate surface at step 506 to be pressed. In one aspect wherein, the lower press plate is grooved, the user places a plug directly onto the lower press plate surface within the interior of the groove pattern. At step 507 the user may select a press activate button analogous to lift button 111 of FIG. 1 (press lift button) to cause the lower press plate and platform assembly to travel upward to bring the press plate surfaces together under force of 1,500 PSI or greater.

At step 508, a user may decide whether an appropriate press time was reached (time that press plates are closed). The press time may be determined by the user visually having experience making prior press runs with the same material. In one aspect, a timer may be automatically set by the unit based on the amount of material placed on the lower press plate surface and the actual temperature of the plates. A sensor may be provided in the press plate surface that detects the presence of the raw material placed on the surface and reports the weight or otherwise estimates the weight of the material plug. The variables may be used by an algorithm running on a small micro-controller in circuitry controlling the display. In that embodiment a visual notification of the expiration of a complete press time may be displayed to the user. If the press time has not been attained at step 508, the user may wait at step 509 until a notification or sound occurs. If at step 508, the user has determined that the press time is completed, the user may select and depress a release button to open the press at step 510. In one aspect, the user may open the press at any time after or before a press time has completed wherein the release button analogous to button 112 of FIG. 1 overrides any programing for safety purpose.

In one aspect of the method, a distance may be preset by the user using the control interface analogous to interface 110 of FIG. 1, the distance defining a maximum gap between the press plates when not pressed together. In that aspect, the lower press plate may automatically travel down to a stop when the user depresses a release button. In still another aspect, the user may place the material on the surface and press the lift button to start the press operation. Thereafter, the unit may calculate the appropriate press time based on heat of the press plates and weight of material, press the plates together and hold them at 1,500 PSI for the duration of the calculated time, and then release the lower plate down to the preset stop.

At step 511, the user may remove the pressed plant material. In one aspect, the user removes the pressed plant material from the parchment paper and any unwanted particulate. The oily wax or resin extracted is pressed out of the plug and forms a liquid (highly viscous) ring about the footprint of the pressed plug. In one aspect wherein, the plant material was placed on a lower groove plate, the user removes the plant material from the lower press plate surface and the oily wax or resin melt flows into the groove.

At step 512, the user may determine to press another batch of raw plant material. If the user determines to run a next batch of material at step 512, the process loops back to step 506 where the next batch may be placed on the lower press plate surface. If the user is done pressing at step 512, the user may collect final product at step 513 and the process ends where pressing is concerned at step 514. In one aspect, final product is scraped off the parchment papers with a provided scraping tool. In another aspect wherein, the lower press plate is grooved, the material may be deposited from the melt groove into a collection bin or tray. A cool down period may be observed before scraping the material off parchment paper.

A mechanical press means architecture may include a base platform as a means for support, a means to house the internal components and circuitry like a device housing secured centrally over the platform base plate, the device housing having an upper means of support such as a top panel. The architecture may accommodate an electric drive and press means for lifting the lower press plate to an upper press plate like an electric linear actuator assembly disposed within the device housing.

A means for lifting the lower platform may be enabled by providing a motor driven travel screw hosting a lift collar threaded over the screw and fixed to the platform. A means for aligning the platforms and press plates is enabled by two or more vertical track posts having a uniform length and diameter arranged and spaced apart symmetrically, the track posts mounted to the device housing defining a track for the lower press plate to follow and functioning as a lift track for the lower press plate platform.

Means for heating the press plates may be enable by providing electric heating elements, wherein a first electric heating element is embedded into the lower press plate and a second electric heating element is embedded into the upper press plate, the first and second electric heating elements including at least one feedback sensor to report temperature. Means for controlling the heat of the press plates may include a heating control interface and display and drive circuitry, whereas means enabling a user to lift and lower the lower press plate may be provided as a press activation user interface including at least an electric button for raising the lower press plate and an electric button for releasing the lower press plate. A means for power distribution to the internal electric components of the press may be enabled by a power supply module that has a cord out through the device housing to an AC plug-in outlet and wiring routed within the device housing to connect the motor, the heating elements and temperature sensors, the display circuitry, and the user heat-control interface.

Figure 6:
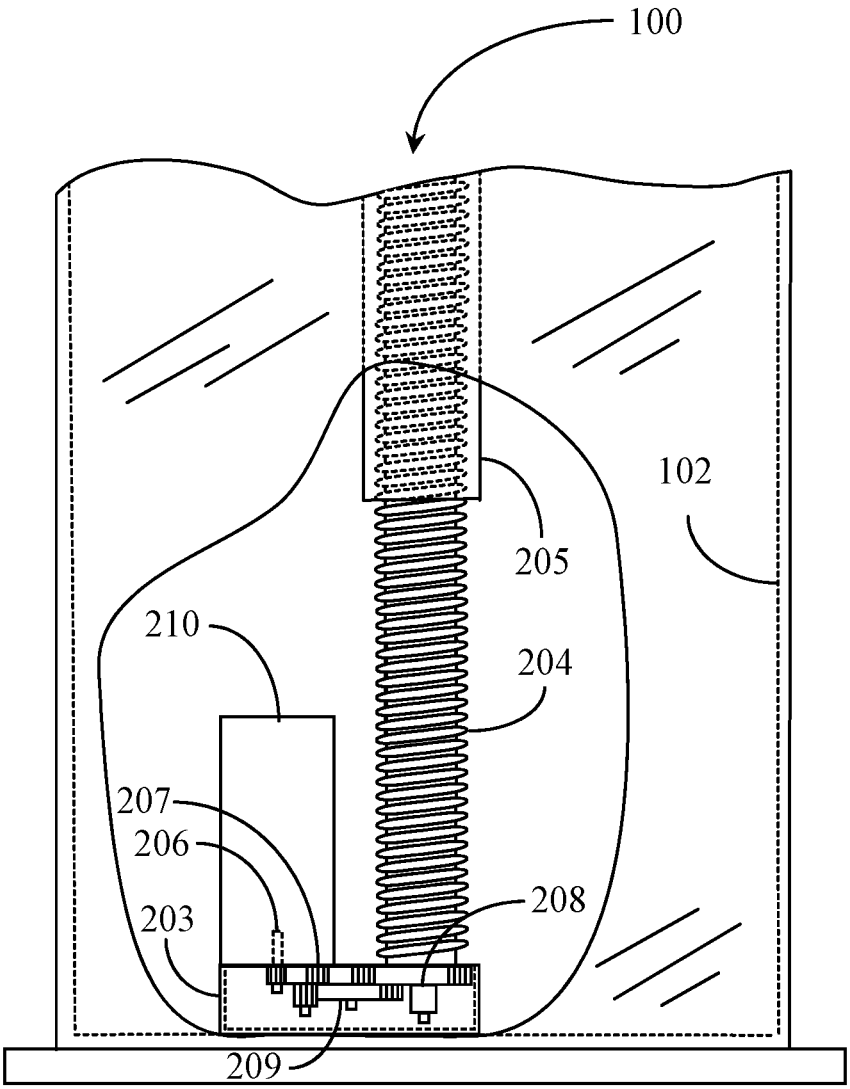
FIG. 6 is a partial right-side view of the press of FIG. 1 with a portion of side panel removed to depict internal actuator components.

FIG. 6 is a partial right-side view of press 100 of FIG. 1 with a portion of side panel removed to depict internal actuator components. Press 100 has the top portion removed and a portion of side panel removed to depict a side view of linear actuator 201. Linear actuator 201 includes motor 210, actuator connection block 203, and vertical travel screw 204. Actuator connection block further has a side wall removed for clarity. Lift collar 205 is fixed to the lower platform assembly and travels up or down travel screw 204 as the travel screw is rotated. Motor 210 is mounted vertically in line with screw 204 on the opposite side of actuator connection block 203 from screw 204. In this view the front of press 100 is to the right of travel screw 204.

Motor 210 includes motor shaft 206 with a fixed gear to drive travel screw 204. Gear 206 aligns with and meshes with first translation gear 207. Gear 207 may be mounted on a vertical gear pin within the actuator connection block 203 and is freely rotable. Gear 207 has two gear mesh diameters that mesh with second translation gear 209, which has a larger overall diameter. Gear 209 may also be pin mounted within block 203 and is freely rotable. Travel screw 204 includes a fixed gear 208 that meshes with translation gear 209. Actuator connection block 203 may be screwed down into position from the bottom surface of the lower press plate platform.

The exact orientation of actuator connection block 203, and motor 210 may vary from this configuration without departing from the spirit and scope of the invention. One with skill in the art of linear actuation may appreciate that motor 210 may be mounted orthogonally from travel screw 204 or at an angle off travel screw 204 without departing from the spirit and scope of the invention. The gear set number (of gears) and the orientation thereof may be changed to accommodate alternate motor positions. It may be noted herein that in one embodiment, there is a device housing frame to which panels may be assembled to creating device housing 102. Bracketing and other mounting hardware may be assumed present though none is specifically illustrated.

Figure 7:
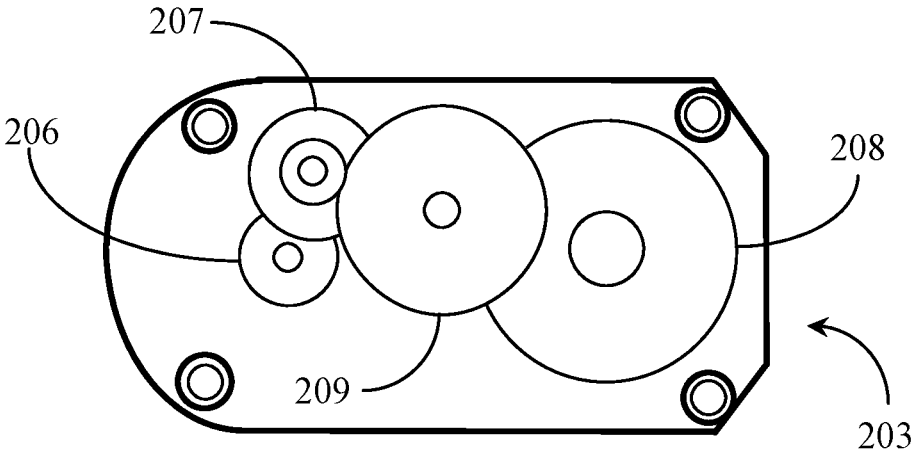
FIG. 7 is a bottom view of the actuator connection block of FIG. 6 with the bottom cover plate removed to depict gear orientation.

FIG. 7 is a bottom view of actuator connection block 203 of FIG. 6 with the bottom cover plate removed to depict gear orientation. Actuator connection block 203 includes the planetary arrangement of gears, 206 (fixed motor shaft), 207 (pin mounted translation gear), 209 (pin mounted translation gear), and 208 (fixed travel screw gear). Perimeter gear meshing is not depicted in this view for each gear 206-209 but may be assumed present. In this embodiment, motor 210 drives travel screw 204 through the gear set within actuator connection box 203. In one embodiment motor 210 maybe a single speed motor. In one embodiment, motor 210 may be adapted to operate at variable selected speeds without departing from the spirit and scope of the present invention. In this embodiment, actuator connection block 203 has a set of gears that produce a static torque enabling travel screw to force a load of 1,500 PSI on the press plates. In another embodiment of the invention there may be an alternate gear and a mechanical gear selector to switch from two different gears to create two different force settings for the press plates without departing from the spirit and scope of the invention.

Figure 8:
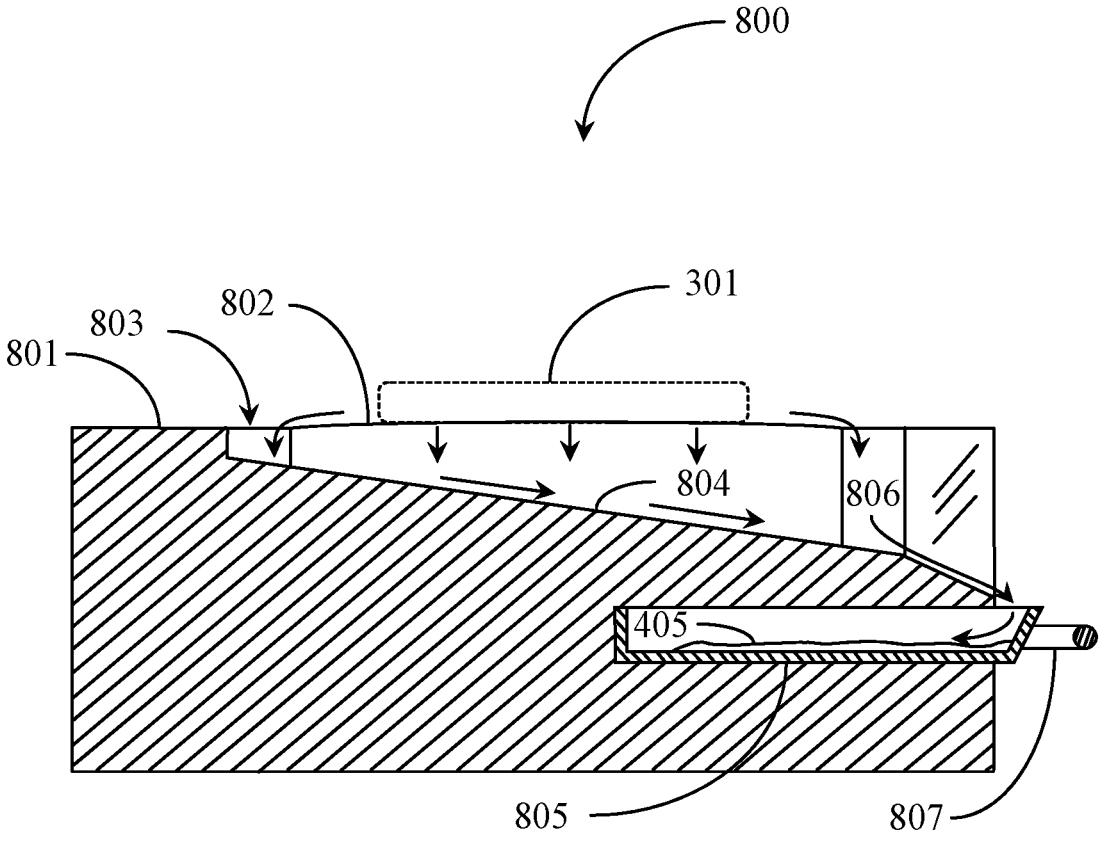
FIG. 8 is a sectioned side view of a lower groove plate 800 with a graduated flow path for viscous material according to an embodiment of the present invention.

FIG. 8 is a sectioned side view of a lower groove plate 800 with a graduated flow path for viscous material according to an embodiment of the present invention. Groove plate 800 is like groove plate 401 of FIG. 4, but includes one or more features not introduced in the groove plate of FIG. 4. Groove plate 800 has a top surface 801 defining the top flat ground or milled surface outside of the groove feature. Groove plate 800 includes a press plate surface 802 that is higher in elevation than flat surface 801. During a press operation involving the upper stationary press plate analogous to press plate 108 of FIG. 1, there may be a small gap between surface 801 and the corresponding surface of the upper press plate.

Press surface 802 may be milled or ground as a convex surface highest at center and graduating down toward the groove feature. The corresponding press plate may be milled or ground to have a concave press surface that substantially matches the lower press plate press surface. Raw material plug 301 is depicted in broken boundary for reference. In this sectioned view, a groove feature 803 like groove feature 403 of FIG. 4 is depicted from the left side of the press unit. Groove feature 803 follows an annular groove pattern that slopes down toward the front of the press unit. The slope angle may be approximately 20 degrees from horizontal. Groove feature 803 includes a melt exit chute 807 that provides passage of melted oils, extracts, or viscous compounds from the groove feature 803 into a collection tray 805.

Collection tray 805 may be inserted into plate 800 in the fashion of a drawer. Tray 805 may include a tray handle 806 enabling a user to insert the tray into plate 800 and to pull it out of plate 800. Groove plate 800 is a heated plate like groove plate 401 and functions to melt the desired essential components in the raw material as it is being pressed. The function of convex surface 802 is to enable a lesser path of resistance for viscous material to squeeze out of plug 301 and down (effected by gravity) into groove 803 as indicated by the direction of the directional arrows emanating from surface 803. The slope angle of groove feature 803 enables a path of least resistance for the viscous compound to flow toward the front of the press plate to melt exit chute 807. The slope angle of exit chute 807 is significantly larger than the slope angle of groove feature 803. For example, groove feature 803 may have a 20-degree slope angle whereas the exit chute has a 30-degree angle out of the press plate.

Collection tray 805 may be a stainless-steel tray having a bottom wall and four side walls and a depth enough to accommodate a buildup of materials 405 deposited therein. In this view, the part of groove feature 803 nearest the viewer is revealed as well as the exit chute 807. In one embodiment, press surface 802 has a conical shape culminating at a high center point and a surrounding gradient surface that slopes the same angle down to groove feature 803. In one embodiment, small radial feeder grooves may be machined into surface 802 in a spoke pattern emanating from near the edge of the plug 301 and breaking out into the groove feature 803.

The heating control interface maintains heat stability to plate 800 maintaining a stable (non-deviating) melt heat for surface area 802 and groove feature 803 in as much that viscosity in the melted compound is important to enable the compound to continue to flow down the groove and into the collection tray 805 underneath exit chute 807. Collection tray 805 may also be a heat target at least to the maintenance of compound viscosity within the tray enabling flow to the rear portions of the tray. In one embodiment, there may be more than one ceramic heating element provided to groove plate 800. For example, an element and sensor may be provided to heat the press plate surface 802 and groove 803, while a separate element and sensor might be provided and enabled for tray 805. In such a case, tray 805 may be programed to be maintained at a same or lower heat level than the press surface level. In one embodiment, material 405 in tray 805 may be allowed to accumulate and cool to a degree that enables a user to take product from the tray and place it in another device for consumption.

In one embodiment of the invention, a sampling chamber or compartment (not illustrated) may be provided within the interior of lower groove plate 800 in an area near enough to groove feature 803 for some of the melted extract to flow into it through a passageway drilled or otherwise machined into the compartment from the groove feature. A sampling chamber may be a small pocket placed just under the rear center portion of groove feature 803. A small opening may be drilled into the pocket from the groove to allow some melted compound to seep through into the pocket. Another passage into the pocket can be provided through the plate material from the rear side of the plate to enable a user to smoke vapor formed in the pocket with an attachment adapted for the purpose.

A carburetion opening may be provided into the pocket from surface 801 or from the rear to assist evacuation of vapor formed in the chamber. A separate heating element may be provided for heating the sample chamber that may attain a level of heat high enough to vaporize the contents allowing a user to taste a melted compound within a time frame of a first press run. In this embodiment, the sample chamber may benefit from the general heat provided by the element adapted to heat the press surface and the groove but may be heated by separate element at will by a user operating a fire button provided and adapted for the purpose.

In one embodiment having a sample chamber, the sample chamber passage to the groove is always open and material fills the pocket up to the groove. The action of heating the sample chamber to vaporize product may be repeated at will during press operation. Tools maybe provided to clean the press parts, collection tray and sample chamber. In another variation of the embodiment having a sample chamber, the passage from the groove to the sample chamber may be manually closed so that no melted compound enters the sample chamber.

Figure 9A:
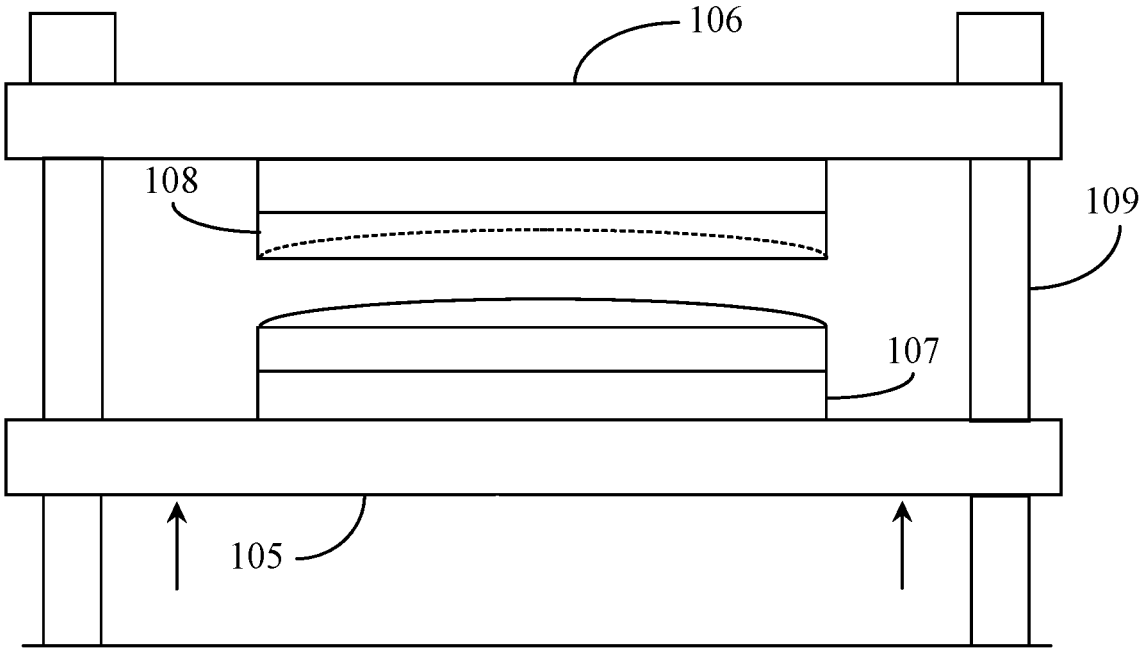
FIG. 9A is a side view of the press of FIG. 1 showing a convex press surface.

FIG. 9A is a side view of the press of FIG. 1 showing lower press plate platform 105 having a lower press plate 107 mounted thereon, wherein 107 has a convex press surface, and fixed upper press plate platform 106 having an upper press plate 108 mounted thereon, wherein 108 has a matching concave press surface.

Figure 9B:
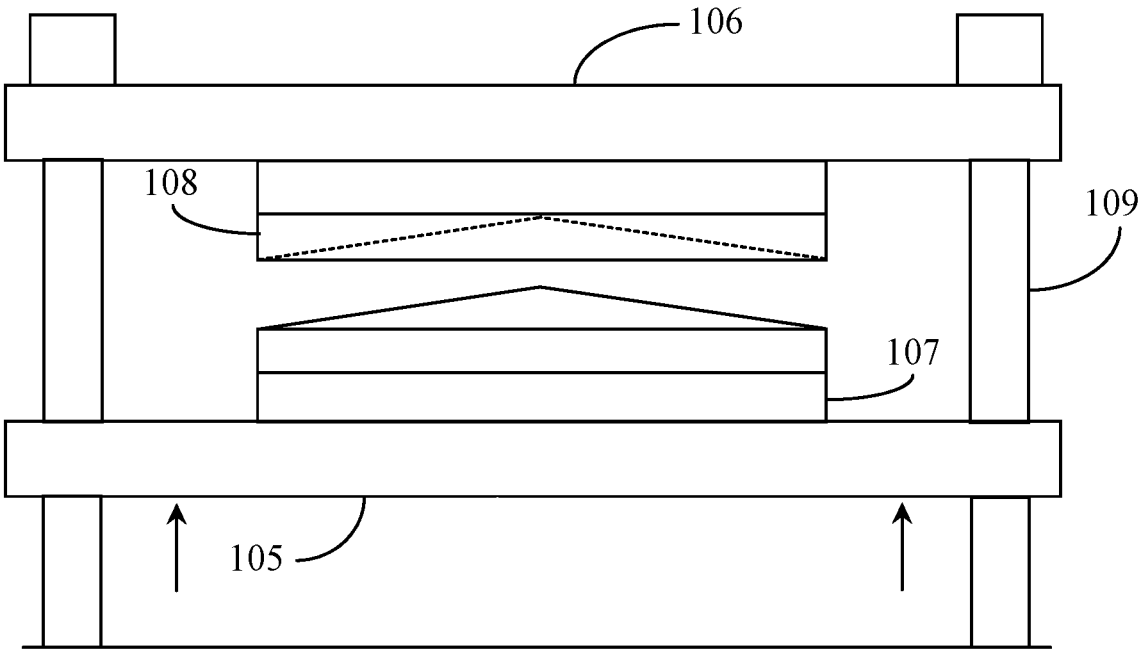
FIG. 9B is a side view of the press of FIG. 1 showing a conical press surface.

FIG. 9*b* is a side view of the press of FIG. 1 showing lower press plate platform 105 having a lower press plate 107 mounted thereon, wherein 107 has a conical press surface, and fixed upper press plate platform 106 having an upper press plate 108 mounted thereon, wherein 108 has a matching funnel surface.

It will be apparent to one with skill in the art that the linear actuated press system of the invention may be provided using some or all the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention. The scope of the invention shall be limited only by the breath of the claims below.

What is claimed is:

1. A mechanical press comprising:

a platform base plate having a length, a width, and a uniform thickness;

a device housing secured centrally over the platform base plate, the device housing having at least front, rear, two side panels, and a top panel having uniform thickness;

an electric linear actuator assembly disposed centrally and in a vertical orientation within the device housing and fixedly mounted to the platform base plate in strategic position within the device housing, the linear actuator including a travel screw having a lower fixed gear, an actuator connection block hosting a planetary gear set, and an electric motor having a drive gear fixed to a motor shaft;

a lift collar having a lower annular tube section with internal threading matching the external threading on the travel screw and an upper attachment seat fixed to a lower press plate platform having a length a width, and a uniform thickness;

two or more vertical track posts having a uniform length and diameter arranged and spaced apart symmetrically, the track posts fixedly mounted to the device housing and extending vertically through the lower press plate platform through provided openings placed through the platform, the track posts functioning as a lift track for the lower press plate platform;

a lower press plate having a length, a width, and a maximum thickness centrally mounted to the top surface of the lower press plate platform;

an upper press plate platform having a length, a width, and a maximum thickness, the upper press plate platform aligned with and held in a same planar relationship to the lower press plate platform, the upper press plate platform having openings placed orthogonally therethrough to accept the track posts and wherein the upper press plate platform is fixed to the track posts at the upper ends of the posts;

an upper press plate having a length, a width, and a uniform maximum thickness centrally mounted to the bottom surface of the upper press plate platform sharing vertical alignment and a parallel planar relationship with the lower press plate;

a first electric heating element embedded into the lower press plate;

a second electric heating element embedded into the upper press plate, the first and second electric heating elements including at least one feed back sensor to report temperature;

a heating control interface and display including at least one electronic circuit for driving the heating control interface and display;

a press activation interface including an electric button for raising the lower press plate platform to press and an electric button for releasing the lower press plate platform from press; and a power supply mounted within the device housing and connected by wire to the electric motor, the first and second heating elements, and to the at least one electronic circuit driving the heating control interface and display.

2. The mechanical press of claim 1, wherein a press force combined with active heating of the lower and upper press plates acts on raw material placed between the press plates to extract resins, oils, extracts, or compounds from the raw material, the heat rendering the resins, oils, extracts, or compounds in a highly viscous liquid state.

3. The mechanical press of claim 1, wherein the lower press plate has a convex press surface, the upper press plate having a matching concave press surface.

4. The mechanical press of claim 1, wherein the lower press plate has a conical press surface, the upper press plate having a matching funnel surface.

5. The mechanical press of claim 1, wherein the press force created by the linear actuator is equal to or greater than 1,500 pounds per square inch.

6. The mechanical press of claim 1 further including a groove milled along a groove pattern around a press plate surface of the lower press plate, the groove including an exit chute breaking out of the lower press plate, a groove bottom graduating downward from the rear of the lower press plate to the front of the lower press plate and out of the exit chute.

7. The mechanical press of claim 1, wherein a material pressed is protected in a fold of parchment paper and pressed resins, oils, extracts, or compounds are collected off the parchment paper.

8. The mechanical press of claim 1, wherein a maximum press force is adjustable.

9. The mechanical press of claim 1, wherein a distance that the lower press plate platform recedes after press release may be set by a user.

* * * * *